US010727600B1

(12) United States Patent
Saeidi et al.

(10) Patent No.: US 10,727,600 B1
(45) Date of Patent: Jul. 28, 2020

(54) COUPLING AND RE-RADIATING SYSTEM FOR MILLIMETER-WAVE ANTENNA

(71) Applicant: MOTOROLA MOBILITY LLC, Chicago, IL (US)

(72) Inventors: Chiya Saeidi, Chicago, IL (US); Eric L. Krenz, Crystal Lake, IL (US)

(73) Assignee: Motorola Mobility LLC, Chicago, IL (US)

( * ) Notice: Subject to any disclaimer, the term of this patent is extended or adjusted under 35 U.S.C. 154(b) by 8 days.

(21) Appl. No.: 16/289,581

(22) Filed: Feb. 28, 2019

(51) Int. Cl.
*H01Q 13/18* (2006.01)
*H01Q 9/04* (2006.01)
*H01Q 1/24* (2006.01)

(52) U.S. Cl.
CPC ..... *H01Q 13/18* (2013.01); *H01Q 1/24* (2013.01); *H01Q 9/0407* (2013.01)

(58) Field of Classification Search
CPC ..... H01Q 13/18; H01Q 9/0407; H01Q 1/24
See application file for complete search history.

(56) References Cited

U.S. PATENT DOCUMENTS 4,965,607 A 10/1990 Wilkins et al.
7,030,819 B2 * 4/2006 Horibe ..... H01Q 1/007 343/702
9,450,298 B2 8/2016 Lee
9,748,651 B2 8/2017 Orsi et al.
2002/0118083 A1 * 8/2002 Pergande ..... H01P 5/107 333/246
2016/0204501 A1 * 7/2016 Bringuier ..... H01Q 7/00 343/702

OTHER PUBLICATIONS

Kunio Sakakibara, "High-gain Millimeter-wave Planar Array Antennas with Traveling-wave Excitation, Radar Technology, Guy Kouemou (Ed.)", Jan. 1, 2010, InTech, pp. 319-340, 24 pages. (Year: 2010).*
Chang, Hsin-Chin et al., "Evanescent-Mode Coupling of Dual-Mode Rectangular Waveguide Filters", IEEE Transactions on Microwave Theory and Techniques, vol. 39, No. 8, Aug. 1991, pp. 1307-1312.
Chu, Hui et al., "A 3-D Millimeter-Wave Filtering Antenna With High Selectivity and Low Cross-Polarization", IEEE Transactions on Antennas and Propagation, vol. 63, No. 5, May 2015, pp. 2375-2380.

* cited by examiner

*Primary Examiner* — Daniel D Chang
(74) *Attorney, Agent, or Firm* — Yudell Isidore PLLC

(57) ABSTRACT

An antenna subsystem of a communication device has an open cavity including an inner opening and lateral and outer sides that define a cavity. The cavity is sized less than required for cavity mode resonance at a millimeter-wave operating frequency. A millimeter-wave antenna element placed at the inner opening of the hollowed section cavity excites evanescent electromagnetic fields in the cavity. A slot antenna is formed in a metallic layer of the outer side of the cavity. A metallic sectioned proximity post has a first section positioned adjacent to and spaced apart from the millimeter-wave antenna element to couple to, and conduct, the evanescent electromagnetic field. The metallic proximity post has a second section positioned adjacent to and spaced apart from the slot antenna to couple at the millimeter-wave operating frequency, enabling re-radiation by the slot antenna.

16 Claims, 7 Drawing Sheets

COUPLING AND RE-RADIATING SYSTEM FOR MILLIMETER-WAVE ANTENNA

BACKGROUND

1. Technical Field

The present disclosure relates generally to communication devices and in particular to communication devices configured with millimeter-wave antennas.

2. Description of the Related Art

Cellular communications has expanded into multiple communication bands and modulation schemes through the evolution of the telecommunications standard from first generation (1G), second generation (2G), third generation (3G), fourth generation (4G), and recently fifth generation (5G). The 5G cellular systems utilize millimeter-wave bands along with phased array antennas at both the mobile device and base station. Generally-known embedded millimeter-wave antenna arrays are not easily fitted into the form factor, or industrial design (ID), of communication devices such as "smart phones". The embedded millimeter-wave antenna arrays must be placed on the outside borders of the smart phone in order for the antenna array to radiate. The outer border positioning necessitates significant size and thickness restrictions, along with considerable modification and trimming of the ID in order for the antenna array to be integrated and to achieve acceptable antenna performance.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
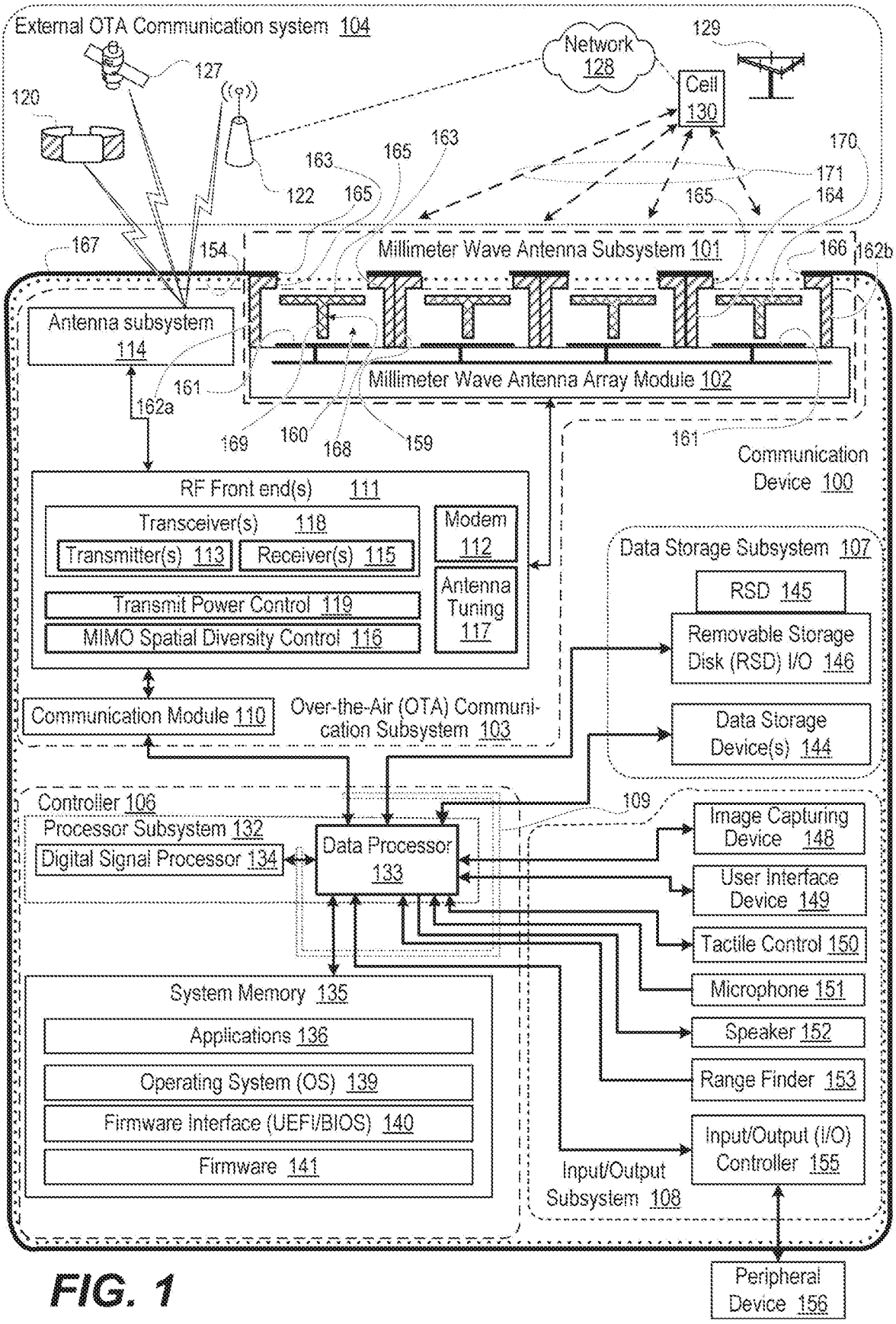
FIG. 1 is a simplified functional block diagram illustrating a communication device that includes a coupling and re-radiating system for millimeter-wave antenna modules, according to one or more embodiments.

According to aspects of the present innovation, a communication device, an antenna subsystem, and a method provide a coupling and re-radiating system for embedded millimeter-wave antenna modules. The coupling and re-radiating system achieves wide angle antenna performance within the size constraints of an industrial design (ID) of communication devices such as smart phones. An antenna subsystem of a communication device has a hollowed section, including an inner opening and lateral and outer metallic sides that define a cavity, which is a "below-cutoff cavity". Since it is imperative to be compact, the size of the cavity is much less than required for cavity mode resonance at a millimeter-wave operating frequency. Thus, a millimeter-wave antenna element located at the inner opening of the cavity only excites an evanescent electromagnetic field in the below-cutoff cavity. A slot antenna is formed in a metallic layer of the outer side of the cavity. A metallic proximity post has a first section positioned adjacent and spaced apart from the millimeter-wave antenna element to couple to, and conduct, energy from the evanescent electromagnetic field. The metallic proximity post has a second section positioned adjacent to and spaced apart from the slot antenna to couple energy at the millimeter-wave operating frequency, to the slot antenna enabling re-radiation. Since the slot is not excited through the cavity modes, but rather via a coupling post perpendicular to the slot, the feed configuration is distinct and different from cavity-backed feeding. Incorporating the antenna subsystem according to the present disclosure provides great flexibility in the design of the phone ID and facilitates a properly customizable antenna solution.

Evanescent waves are fast dying waves that, here, propagate vertically from the surface of the embedded millimeter-wave antenna module. In electromagnetics, an evanescent field, or evanescent wave, is an oscillating electric and/or magnetic field that does not propagate as an electromagnetic wave but whose energy is spatially concentrated in the vicinity of the source (oscillating charges and currents). The metallic proximity post allows the evanescent field to be radiated by the slot antenna.

Dimensions of the metallic proximity post provides efficient coupling at an intended operating frequency and bandwidth of the re-radiation system. To empirically determine the precise required dimensions, in one or more embodiments, a metallic proximity post is formed with a stepped structure that can be tuned during a simulation design stage to achieve desired antenna performance at a selected operating frequency. The proposed coupling structure provided by a metallic stepped proximity post makes it possible to transfer radio frequency (RF) energy from an antenna module inside a phone to a radiating structure on a housing of the phone. The antenna subsystem can be easily integrated into the metal housing of a phone without imposing restrictions to ID. In one or more embodiments, multiple hollowed sections having respective below-cutoff cavities are provided for an antenna array having multiple antenna elements. Each hollowed section provides necessary isolation between antenna elements of the array. The antenna subsystem can be less directive than the antenna array module. In particular, the antenna array provides a beam width increase, which enables achievement of an important 5G millimeter-wave spherical coverage requirement.

In the following detailed description of exemplary embodiments of the disclosure, specific exemplary embodiments in which the various aspects of the disclosure may be practiced are described in sufficient detail to enable those skilled in the art to practice the invention, and it is to be understood that other embodiments may be utilized and that logical, architectural, programmatic, mechanical, electrical and other changes may be made without departing from the spirit or scope of the present disclosure. The following detailed description is, therefore, not to be taken in a limiting sense, and the scope of the present disclosure is defined by the appended claims and equivalents thereof. Within the descriptions of the different views of the figures, similar elements are provided similar names and reference numerals as those of the previous figure(s). The specific numerals assigned to the elements are provided solely to aid in the description and are not meant to imply any limitations (structural or functional or otherwise) on the described embodiment. It will be appreciated that for simplicity and clarity of illustration, elements illustrated in the figures have not necessarily been drawn to scale. For example, the dimensions of some of the elements are exaggerated relative to other elements.

It is understood that the use of specific component, device and/or parameter names, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that term is utilized.

As further described below, implementation of the functional features of the disclosure described herein is provided within processing devices and/or structures and can involve use of a combination of hardware, firmware, as well as several software-level constructs (e.g., program code and/or program instructions and/or pseudo-code) that execute to provide a specific utility for the device or a specific functional logic. The presented figures illustrate both hardware components and software and/or logic components.

Those of ordinary skill in the art will appreciate that the hardware components and basic configurations depicted in the figures may vary. The illustrative components are not intended to be exhaustive, but rather are representative to highlight essential components that are utilized to implement aspects of the described embodiments. For example, other devices/components may be used in addition to or in place of the hardware and/or firmware depicted. The depicted example is not meant to imply architectural or other limitations with respect to the presently described embodiments and/or the general invention.

The description of the illustrative embodiments can be read in conjunction with the accompanying figures. Embodiments incorporating teachings of the present disclosure are shown and described with respect to the figures presented herein.

FIG. 1 is a simplified functional block diagram illustrating example communication device 100 that incorporates a millimeter-wave antenna subsystem 101 that couples and re-radiates millimeter (mm)-wave radio frequency (RF) evanescent field energy from millimeter-wave antenna array module 102. Communication device 100 can be one of a host of different types of devices, including but not limited to, a mobile cellular phone or smart-phone, a laptop, a net-book, an ultra-book, a networked smart watch or networked sports/exercise watch, and/or a tablet computing device or similar device that can include wireless communication functionality. As a device supporting wireless communication, communication device 100 can be one of, and also be referred to as, a system, device, subscriber unit, subscriber station, mobile station (MS), mobile, mobile device, remote station, remote terminal, user terminal, terminal, user agent, user device, cellular telephone, a satellite phone, a cordless telephone, a Session Initiation Protocol (SIP) phone, a wireless local loop (WLL) station, a personal digital assistant (PDA), a handheld device having wireless connection capability, a computing device, or other processing devices connected to a wireless modem. These various devices all provide and/or include the necessary hardware and software to support the various wireless or wired communication functions as part of a communication system. Communication device 100 can also be an over-the-air link in a communication system. Communication device 100 can be intended to be portable, hand-held, or fixed in location. Examples of such over-the-air link communication devices (100) include a wireless modem, an access point, a repeater, a wirelessly-enabled kiosk or appliance, a femtocell, a small coverage area node, and a wireless sensor, etc.

Referring now to the specific component makeup and the associated functionality of the presented components, communication device 100 includes over-the-air (OTA) communication subsystem 103 that communicates with external OTA communication system 104. Communication device 100 provides computing and data storage functionality in support of OTA communication with external OTA communication system 104, as well as other functions. Communication device 100 includes controller 106, data storage subsystem 107, and input/output (I/O) subsystem 108, which are communicatively coupled to each other via a system interlink 109.

OTA communication subsystem 103 includes communication module 110, which operates in baseband to encode data for transmission and decodes received data, according to an applicable communication protocol. OTA communication subsystem 103 includes radio frequency (RF) front end(s) 111 having one or more modems 112. Modems 112 modulate baseband encoded data from communication module 110 onto a carrier signal to provide a transmit signal that is amplified by transmitter(s) 113. Communication device 100 can include multiple antenna subsystems for providing wider directional coverage and/or supporting additional communication frequency bands. In one or more embodiments, communication device 100 can include one millimeter-wave antenna subsystem 101. In one or more embodiments, communication device 100 can include two or more millimeter-wave antenna arrays 101, such as for achieving spherical antenna coverage (not shown). In one or more embodiments, communication device 100 can include no antenna subsystem for frequencies lower than millimeter-wave. Alternatively, in one or more embodiments, communication device 100 can include one or more antenna subsystems 114 (not shown) for frequencies lower than millimeter-wave. For clarity, only two antenna subsystems (101, 114) are illustrated, with antenna subsystem 101 supporting millimeter-wave communication and antenna subsystem 114 supporting other lower communication frequencies.

Antenna arrays 101, 114 transmit and receive signals. Modem 112 demodulates the received signal from antenna arrays 101, 114. The received signal is amplified and filtered by receiver(s) 115, separating received encoded data from a received carrier signal. Multiple-input multiple-output (MIMO) spatial diversity control 116 can utilize antenna elements within one or more antenna arrays 101, 114 to actively and directionally steer antenna gain in order to improve communication performance. Antenna tuning circuitry 117 adjusts antenna impedance of antenna arrays 101, 114 to improve antenna efficiency at desired transmit or receive frequencies of transmitters 113 and receivers 115, respectively, of transceiver(s) 118. RF front end(s) 111 includes transmit power control 119 to adjust uplink transmit power, as required, to effectively communicate with external OTA communication system 104.

Controller 106 controls the communication, user interface, and other functions and/or operations of communication device 100. These functions and/or operations include, but are not limited to including, application data processing and signal processing. Communication device 100 may use hardware component equivalents for application data processing and signal processing. For example, communication device 100 may use special purpose hardware, dedicated processors, general purpose computers, microprocessor-based computers, micro-controllers, optical computers, analog computers, dedicated processors and/or dedicated hard wired logic. As utilized herein, the term "communicatively coupled" means that information signals are transmissible through various interconnections, including wired and/or wireless links, between the components. The interconnections between the components can be direct interconnections that include conductive transmission media or may be indirect interconnections that include one or more intermediate electrical components. Although certain direct interconnections (interlink 109) are illustrated in FIG. 1, it is to be understood that more, fewer, or different interconnections may be present in other embodiments.

In one or more embodiments, controller 106 controls OTA communication subsystem 103 to perform multiple types of OTA communication with external OTA communication system 104. OTA communication subsystem 103 can communicate with one or more personal access network (PAN) devices, such as smart watch 120, which that is reached via Bluetooth connection. OTA communication subsystem 103 can communicate with one or more locally networked devices via a wireless local area network (WLAN) link provided by WLAN node 122. OTA communication subsystem 103 can communicate with global positioning system (GPS) satellites 127 to obtain geospatial location information. WLAN node 122 is in turn connected to wide area network 128, such as the Internet. OTA communication subsystem 103 can also communicate with radio access network (RAN) 129 having respective base stations (BSs) or cells 130. RANs 129 are a part of a wireless wide area network (WWAN) that is connected to wide area network 128 and provides data and voice services.

Controller 106 includes processor subsystem 132, which executes program code to provide functionality of communication device 100. Processor subsystem 132 includes one or more central processing units (CPUs) ("data processor") 133. Processing subsystem 132 can include a digital signal processor (DSP) 134. Controller 106 includes system memory 135 which contains actively used program code and data. System memory 135 can include therein a plurality of program code and modules, including applications 136, operating system (OS) 139, firmware interface 140, such as basic input/output system (BIOS) or Uniform Extensible Firmware Interface (UEFI), and platform firmware 141. These software and/or firmware modules have varying functionality when their corresponding program code is executed by processor subsystem 132 or secondary processing devices within communication device 100.

Data storage subsystem 107 provides nonvolatile storage, accessible to controller 106. For example, data storage subsystem 107 can provide a large selection of applications 136 that can be loaded into system memory 135. Local data storage device(s) 144 can include hard disk drives (HDDs), optical disk drives, and solid state drives (SSDs), etc. In one or more embodiments, removable storage device (RSD) 145 is received in RSD interface 146. RSD 145 is a computer readable storage device, which can be referred to as non-transitory computer readable medium. RSD 145 is an example of a computer program product that can be accessed by controller 106 to provision communication device 100 with program code that when executed by controller 106 provides the functionality to enable or configure communication device 100 to perform aspects of the present innovation described herein.

Input and output (I/O) subsystem 108 provides input and output devices. I/O subsystem 108 can include a sensor for detecting when a person is in proximity to communication device 100. For example, image capturing device 148, such as a camera, can detect gestures and receive/capture other image data. User interface device 149 can present visual or tactile outputs as well as receive user inputs. Tactile/haptic control 150 can provide an interface for physical contact, such as for braille reading or manual inputs. Microphone 151 receives audible inputs. Audio speaker 152 can provide audio output, including audio playback and alerts. Range finder 153 can emit a waveform of energy, such as acoustic, infrared, radio frequency (RF), etc., whose time of flight can be used to measure distance to a reflecting object. I/O subsystem 108 can be wholly or substantially encompassed by device housing 154. In one or more embodiments, portions of I/O subsystem 108 can be connected via I/O controller 155 as peripheral device 156. I/O controller 155 can also interface with wired local access network (LAN).

In one or more embodiments, FIGS. 1-5 illustrate antenna subsystem 101 of communication device 100 having embedded millimeter-wave antenna array module 102 that is integrated within housing 154 by coupling and re-radiating system 157. Coupling and re-radiating system 157 (FIG. 2) includes at least one hollowed section 160 positioned against corresponding millimeter-wave antenna element 161, such as a patch antenna, of embedded millimeter-wave antenna array module 102. Each hollowed section 160 includes inner opening 159 that receives corresponding millimeter-wave antenna element 161. Each hollowed section 160 includes left and right lateral sides 162*a*, 162*b* and outer side 163 that define cavity 164. Transmitter 113 is communicatively coupled to millimeter-wave antenna element 161 to selectively excite millimeter-wave antenna element 161 which in turn generates the evanescent electromagnetic field at the millimeter-wave operating frequency within cavity 164. Hollowed section 160 includes slot antenna 166 formed as an aperture in outer side 163, which is metallic. In one or more embodiments, exterior band 167 of communication device 100 is attached overtop of outer side 163 and has openings 165 that expose slot antenna 166. Exterior band 167 can be metallic, forming at least a portion of slot antenna 166. In one or more embodiments, a hollowed section has lateral sides without an integral outer side to enclose a cavity (not shown). An exterior band provides an outer wall that encloses the cavity and includes a slot antenna.

Cavity 164 is sized less than required for cavity mode resonance at a millimeter-wave operating frequency. The small size of cavity 164 is made for considerations other than antenna performance. Millimeter-wave antenna element 161 is unable to couple to slot antenna 166 without introduction of metallic proximity post 168 positioned in cavity 164, such as by being embedded in RF transmissive plastic (not shown) that fits within cavity 165. In one or more embodiments, metallic proximity post 168 has first section 169 positioned adjacent to and spaced apart from the millimeter-wave antenna element 161 to couple to, and conduct, energy from the evanescent electromagnetic field to second section 170. Second section 170 of metallic proximity post 168 is positioned adjacent to and spaced apart from slot antenna 166 to excite at the millimeter-wave operating frequency, enabling re-radiation 171 by slot antenna 166.

Figure 2:
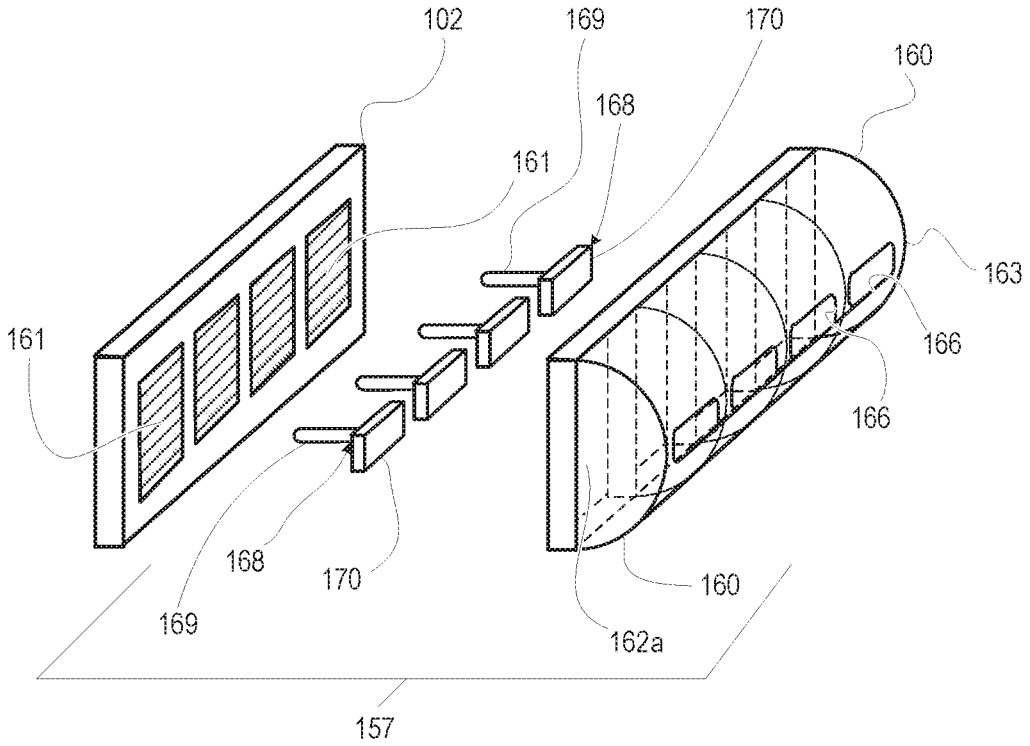
FIG. 2 is an isometric exploded view of an antenna subsystem having a millimeter-wave antenna module and a coupling and re-radiating system, according to one or more embodiments.

FIG. 2 illustrates antenna subsystem 101 having millimeter-wave antenna module 102 and coupling and re-radiating system 157. With particular reference to FIGS. 1 and 2, in one or more embodiments millimeter-wave antenna array module 102 includes a plurality of millimeter-wave antenna elements 161. Each millimeter-wave antenna element 161 of the millimeter-wave antenna module 102 is equally spaced respective to an adjacent millimeter-wave antenna element 161. Transmitter 113 excites each millimeter-wave antenna element 161 with specific phase intervals, as compared to an adjacent millimeter-wave antenna element 161, to create beam shaping. Each millimeter-wave antenna element 161 is assembled with corresponding hollowed section 160, corresponding slot antenna 166, and corresponding metallic proximity post 168 that enables the re-radiation by slot antenna 166 with increased 3 dB beam width compared to millimeter-wave antenna array module 102 itself.

Figure 3:
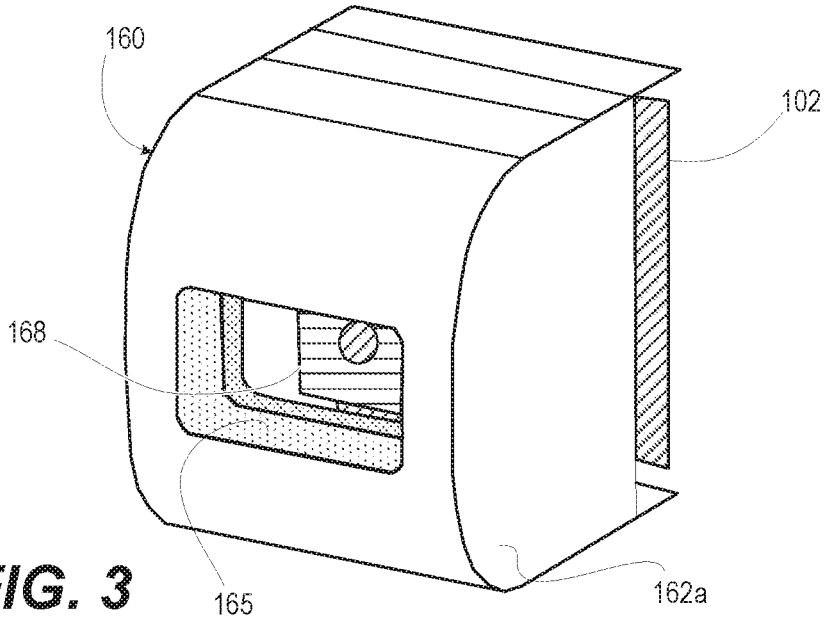
FIG. 3 is an isometric cutaway view of the antenna subsystem of FIG. 2, including one hollowed section, according to one or more embodiments.

FIG. 3 illustrates that lateral sides 162*a*, 162*b* (FIG. 4), and outer side 163 of hollowed section 160. Hollowed section 160 is metallic. Hollowed section 160 for the corresponding assembled combination of millimeter-wave antenna element 161, cavity 164, metallic proximity post 168, and slot antenna 166 are electromagnetically isolated from an adjacent assembled combination by lateral sides 162*a*, 162*b*, and outer side 163 that are metallic.

Figure 4:
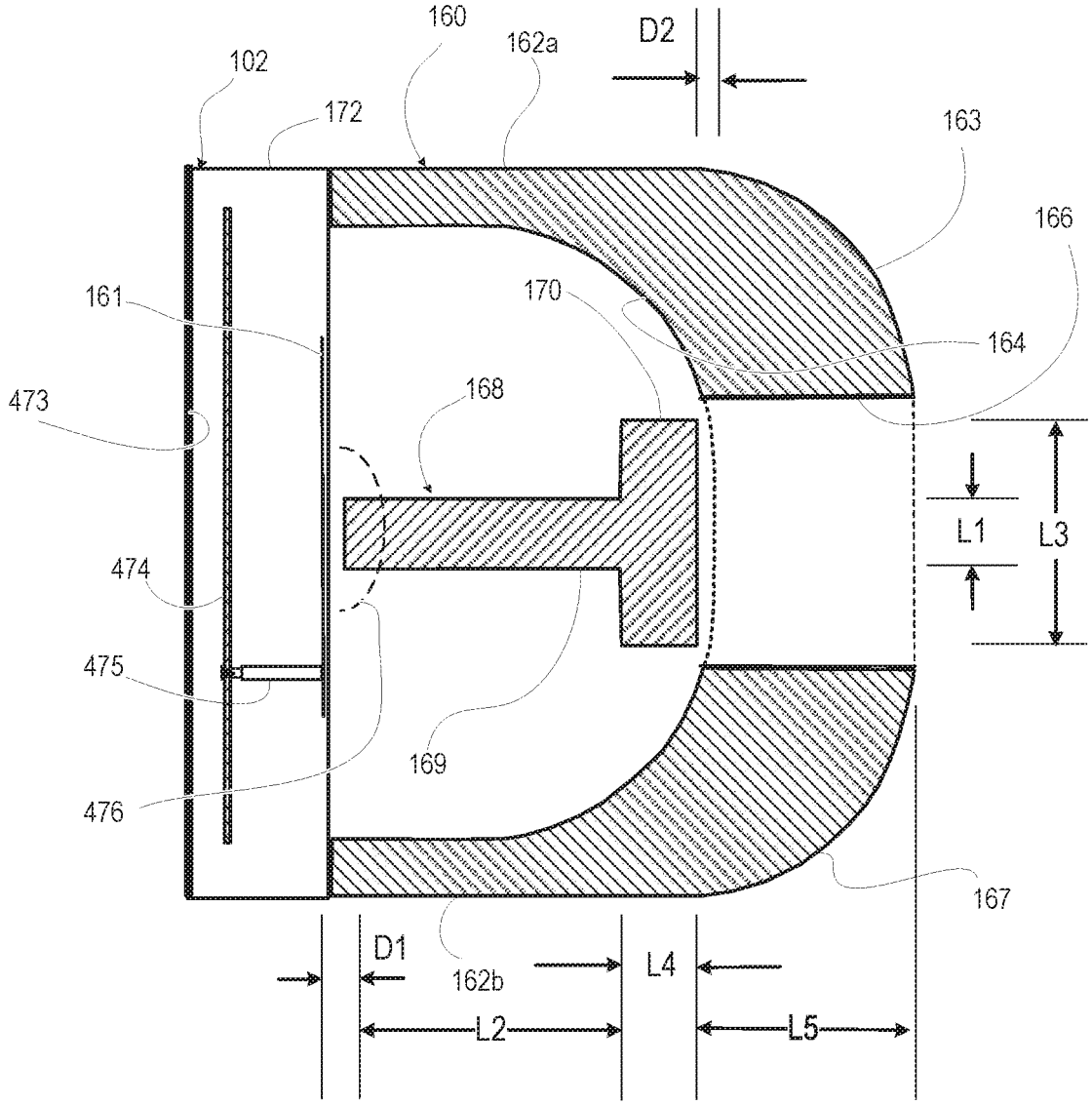
FIG. 4 is a side cross-sectional view of the antenna subsystem of FIG. 2, according to one or more embodiments.

With particular reference to FIG. 4, millimeter-wave antenna array module 102 includes housing 472 with conductive ground plane 473 on an opposite side to millimeter-wave antenna element 161. Frontend baseboard 474 feeds millimeter-wave energy, via respective feedlines 475, to millimeter-wave antenna element 161. Millimeter-wave antenna element 161 excites evanescent field 476, which couples first section 169 of metallic proximity post 168. First section 169 has a first lateral area related to transverse length "L1" and longitudinal length "L2". Metallic proximity post 168 can have a circular or rectangular cross section. Second section 170 has a second lateral area related to transverse length "L3", which is larger than the first lateral area to form a metallic stepped proximity post. Second section 170 is sized to correspond to slot antenna 166. Second section 170 can have a longitudinal length "L4" that is shorter than longitudinal length "L2" of first section 169.

In one or more embodiments, metallic proximity post 168 includes first section 169 and second section 170. First section 169 is attached to second section 170 and has longitudinal length "L2". Metallic stepped proximity post is positioned within cavity 164 to have distance "D1" between first section 169 and millimeter-wave antenna element 161. A longitudinal distance "D2" is between second section 169 and slot antenna 166 in outer side 163 of hollowed section 160.

Figure 5:
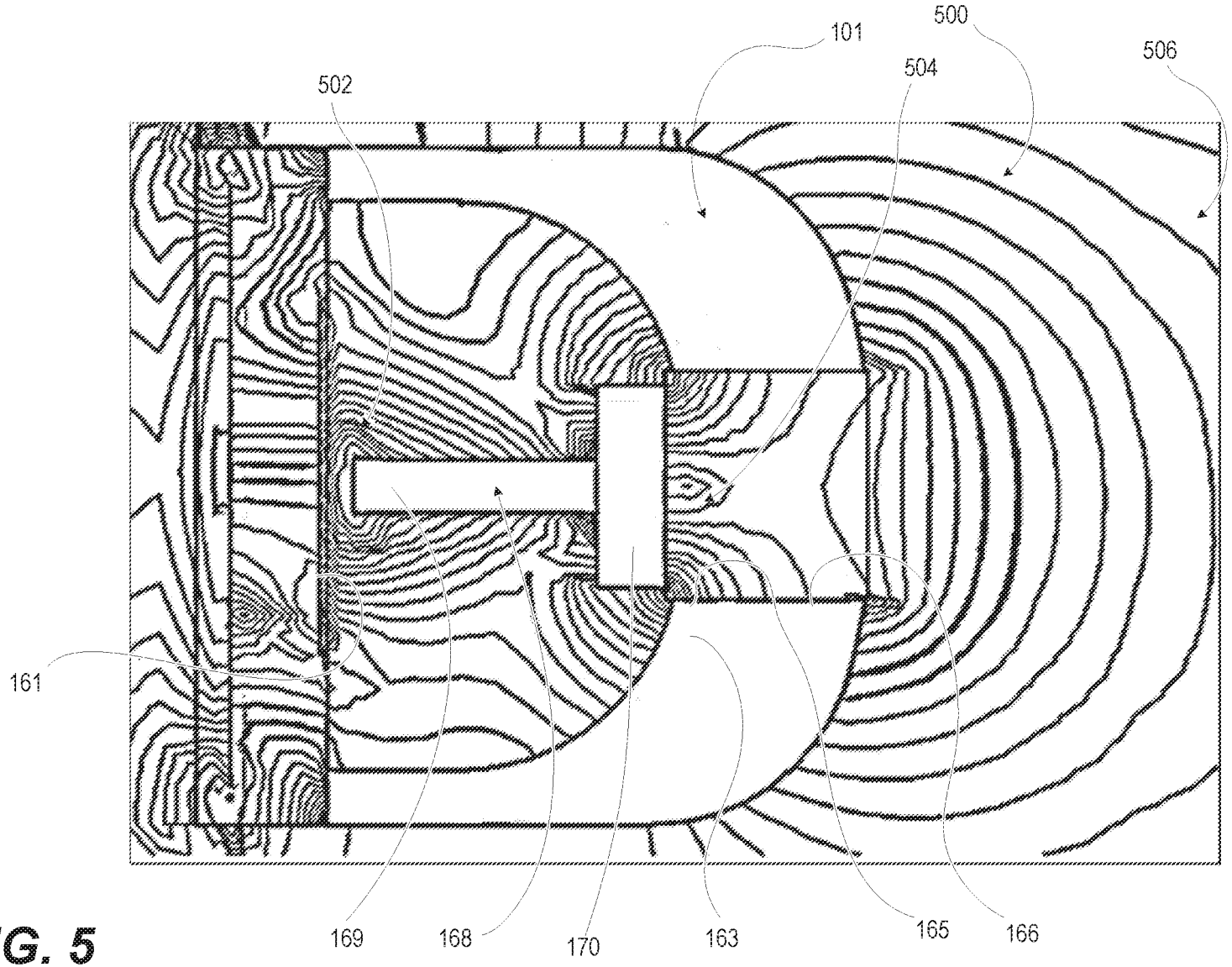
FIG. 5 is a side, cross-sectional view illustrating the antenna subsystem annotated with a radiation pattern, according to one or more embodiments.

FIG. 5 illustrates antenna subsystem 101 annotated with millimeter-wave radiation pattern 500 that includes evanescent field coupling 502 between millimeter-wave antenna element 161 and first section 169 of metallic proximity post 168. Millimeter-wave radiation pattern 500 includes re-radiation evanescent field coupling 504 between second section 170 of metallic proximity post 168 and aperture 165 in outer side 163 of hollowed section 160 and slot antenna 166. Millimeter-wave radiation pattern 500 includes radiation of the energy from slot antenna 166 as communication uplink 506.

Figure 6:
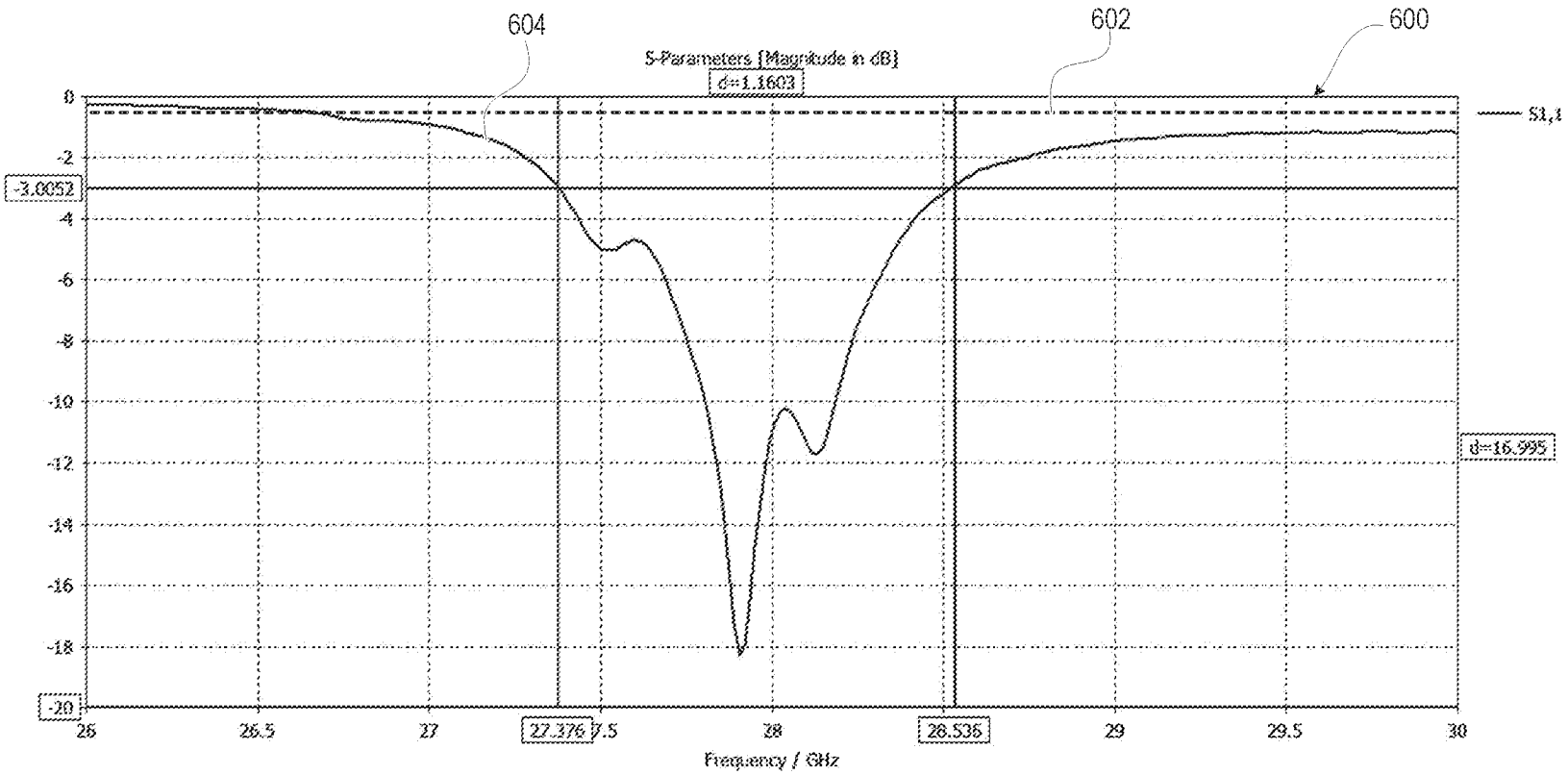
FIG. 6 is a graphical plot illustrating coupling of an evanescent field provided by a metallic proximity post of the antenna subsystem, according to one or more embodiments.

FIG. 6 illustrates a graphical plot comparison 600 between baseline plot 602 for a hollowed section without a metallic proximity post and plot 604 for the hollowed section that includes a metallic proximity post according to aspects of the present innovation. The hollowed section is too small for cavity mode resonance, so plot 602 illustrates scattering parameters (S-parameters) that indicate that no coupling occurs. S-parameters are the elements of a scattering matrix or S-matrix that describe the electrical behavior of linear electrical networks when undergoing various steady state stimuli by electrical signals. In contrast with plot 602, plot 604 illustrates S-parameters of about −18 dB that occur approximately at frequency 28 GHz. Plot 604 indicates coupling, conduction, and re-radiation by the metallic proximity post positioned in the hollowed section. The coupling demonstrates efficient antenna performance by antenna subsystem 101 (FIG. 1).

Figure 7:
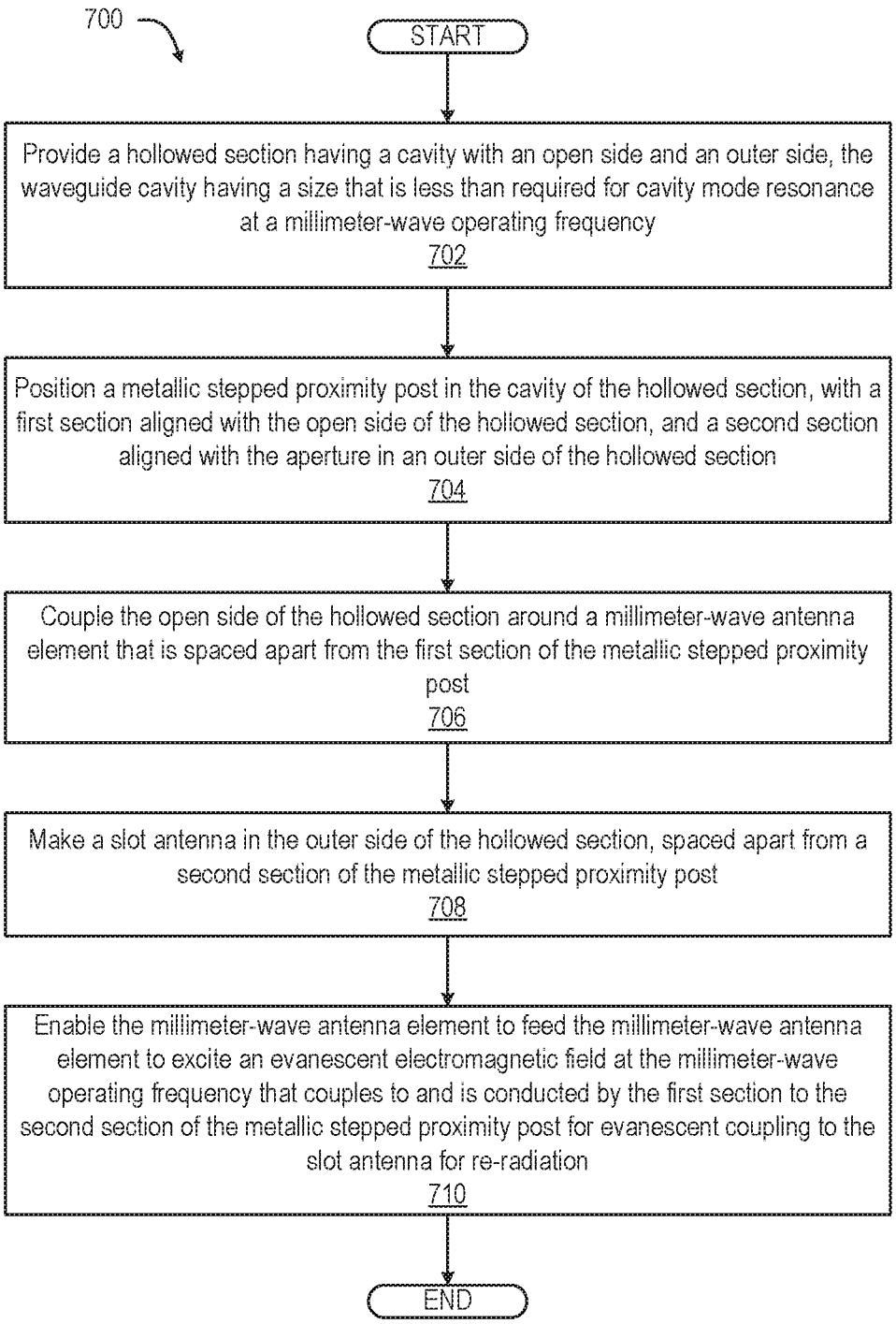
FIG. 7 is a flow diagram illustrating a method for assembling and customizing an antenna subsystem that couples and re-radiates an evanescent field from an embedded millimeter-wave antenna array, according to one or more embodiments.

FIG. 7 is a flow chart that illustrates method 700 for assembling and customizing dimensions of an antenna subsystem that couples and re-radiates an evanescent field from an embedded millimeter-wave antenna array at a selected operating frequency. In one or more embodiments, method 700 includes providing, by an automated inventory system, a hollowed section having a cavity with an open side and an outer side, the cavity having a size that is less than required for cavity mode resonance at a millimeter-wave operating frequency (block 702). Method 700 includes positioning, by an automated manufacturing system, a metallic stepped proximity post in the cavity of the hollowed section, with a first section aligned with the open side of the hollowed section and the second section aligned with the aperture in an outer side of the hollowed section (block 704). Method 700 includes positioning the open side of the hollowed section around a millimeter-wave antenna element that is spaced apart from the first section of the metallic stepped proximity post (block 706). Method 700 includes making a slot antenna in the outer side of the hollowed section, spaced apart from a second section of the metallic stepped proximity post (block 708). Method 700 includes feeding the millimeter-wave antenna element to excite an evanescent electromagnetic field at the millimeter-wave operating frequency that couples to and is conducted by the metallic stepped proximity post for coupling to the slot antenna for re-radiation (block 710). Then method 700 ends.

In each of the above flow charts presented herein, certain steps of the methods can be combined, performed simultaneously or in a different order, or perhaps omitted, without deviating from the spirit and scope of the described innovation. While the method steps are described and illustrated in a particular sequence, use of a specific sequence of steps is not meant to imply any limitations on the innovation.

Changes may be made with regards to the sequence of steps without departing from the spirit or scope of the present innovation. Use of a particular sequence is therefore, not to be taken in a limiting sense, and the scope of the present innovation is defined only by the appended claims.

As will be appreciated by one skilled in the art, embodiments of the present innovation may be embodied as a system, device, and/or method. Accordingly, embodiments of the present innovation may take the form of an entirely hardware embodiment or an embodiment combining software and hardware embodiments that may all generally be referred to herein as a "circuit," "module" or "system."

Aspects of the present innovation are described below with reference to flowchart illustrations and/or block diagrams of methods, apparatus (systems) and computer program products according to embodiments of the innovation. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

While the innovation has been described with reference to exemplary embodiments, it will be understood by those skilled in the art that various changes may be made, and equivalents may be substituted for elements thereof without departing from the scope of the innovation. In addition, many modifications may be made to adapt a particular system, device or component thereof to the teachings of the innovation without departing from the essential scope thereof. Therefore, it is intended that the innovation not be limited to the particular embodiments disclosed for carrying out this innovation, but that the innovation will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the innovation. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present innovation has been presented for purposes of illustration and description but is not intended to be exhaustive or limited to the innovation in the form disclosed. Many modifications and variations will be apparent to those of ordinary skill in the art without departing from the scope and spirit of the innovation. The embodiment was chosen and described in order to best explain the principles of the innovation and the practical application, and to enable others of ordinary skill in the art to understand the innovation for various embodiments with various modifications as are suited to the particular use contemplated.

What is claimed is:

1. A communication device comprising:

a hollowed section including an inner opening and lateral and outer sides that define a cavity, the cavity sized less than required for cavity mode resonance at a millimeter-wave operating frequency;

a millimeter-wave antenna element at the inner opening of the cavity and which excites an evanescent electromagnetic field in the cavity;

a slot antenna formed in a metallic layer of the outer side of the cavity; and a metallic proximity post having: (i) a first section positioned adjacent and spaced apart from the millimeter-wave antenna element to couple to, and conduct, the evanescent electromagnetic field; and (ii) a second section positioned adjacent and spaced apart from the slot antenna to couple at the millimeter-wave operating frequency enabling re-radiation by the slot antenna.

2. The communication device of claim 1, further comprising a millimeter-wave transmitter communicatively coupled the millimeter-wave antenna element to selectively feed the millimeter-wave antenna element to excite the evanescent electromagnetic field at the millimeter-wave operating frequency within the cavity.

3. The communication device of claim 2, wherein the millimeter-wave antenna element is one of a plurality of millimeter-wave antenna elements of a millimeter-wave antenna module having more than one millimeter-wave antenna element, each millimeter-wave antenna element of the millimeter-wave antenna module equally linearly spaced respective to an adjacent millimeter-wave antenna element, the millimeter-wave transmitter exciting each millimeter-wave antenna element with specific phase intervals as compared to an adjacent millimeter-wave antenna element to create antenna beam shaping, each millimeter-wave antenna element assembled with a corresponding cavity that comprises a corresponding slot antenna and a corresponding metallic proximity post that enables the re-radiation by the corresponding slot antenna with increased 3 dB beam width compared to the module itself.

4. The communication device of claim 3, further comprising more than one of said hollowed section, wherein each one of the more than one hollowed section comprises metallic lateral sides that electromagnetically isolate a respective one of the corresponding assembled combination of millimeter-wave antenna element, cavity, metallic proximity post, and slot antenna from an adjacent assembled combination and the rest of the communication device.

5. The communication device of claim 1, wherein the metallic layer comprises an exterior band.

6. The communication device of claim 1, wherein the millimeter-wave antenna element comprises a patch antenna.

7. The communication device of claim 1, wherein the first section of the metallic proximity post has a first lateral area and the second section has a second lateral area that is larger than the first lateral area and sized to correspond to the slot antenna and to form a metallic stepped proximity post.

8. An antenna subsystem comprising:

a hollowed section including an inner opening and lateral and outer sides that define a cavity, the cavity having respective dimensions less than required for cavity mode resonance at a millimeter-wave operating frequency;

a millimeter-wave antenna element at the inner opening of the cavity of the hollowed section that excites evanescent electromagnetic fields in the cavity;

a slot antenna formed in a metallic layer aligned with an aperture in the outer side of the cavity; and a metallic proximity post having: (i) a first section positioned adjacent and spaced apart from the millimeter-wave antenna element to couple to, and conduct, the evanescent electromagnetic field; and (ii) a second section electrically coupled to the first section and positioned adjacent and spaced apart from the slot antenna to evanescently couple at the millimeter-wave operating frequency enabling re-radiation by the slot antenna.

9. The antenna subsystem of claim 8, further comprising an antenna feed connected to the millimeter-wave antenna element and communicatively engageable to a millimeter-wave transmitter of a communication device to selectively excite the millimeter-wave antenna element.

10. The antenna subsystem of claim 9, further comprising a millimeter-wave antenna module having more than one of said millimeter-wave antenna element, each millimeter-wave antenna element equally linearly spaced respective to an adjacent millimeter-wave antenna element, wherein the antenna feed enables the millimeter-wave transmitter to excite each millimeter-wave antenna element with specific phase intervals as compared to an adjacent millimeter-wave antenna element to control the shape and direction of the beam, each antenna element assembled with a corresponding cavity, slot antenna and metallic proximity post that enables the re-radiation by the slot antenna with increased 3 dB beam width compared to the module itself.

11. The antenna subsystem of claim 10, further comprising more than one of said hollowed section, wherein each one of the more than one hollowed section comprises metallic lateral sides that electromagnetically isolate each corresponding assembled combination of millimeter-wave antenna element, cavity, metallic proximity post, and slot antenna from an adjacent combination.

12. The antenna subsystem of claim 9, wherein the metallic layer comprises an exterior band.

13. The antenna subsystem of claim 9, wherein the millimeter-wave antenna element comprises a patch antenna.

14. The antenna subsystem of claim 9, wherein the first section of the metallic proximity post has a first lateral area and the second section has a second lateral area that is larger than the first lateral area and sized to correspond to the slot antenna and to form a metallic stepped proximity post.

15. A method comprising:

providing a hollowed section having a cavity with an open side and an outer side, the cavity having a size that is less than required for cavity mode resonance at a millimeter-wave operating frequency;

positioning a metallic stepped proximity post in the cavity of the hollowed section, with a first section aligned with the open side of the hollowed section, the second section aligned with an aperture in the outer side of the hollowed section;

coupling the open side of the hollowed section around a millimeter-wave antenna element that is spaced apart from the first section of the metallic stepped proximity post; and coupling a slot antenna over the aperture in the outer side of the hollowed section, spaced apart from a second section of the metallic stepped proximity post.

16. The method of claim 15, further comprising enabling the millimeter-wave antenna element to radiate an evanescent electromagnetic field at the millimeter-wave operating frequency that couples to and is conducted by the first section to the second section of the metallic stepped proximity post for evanescent coupling to and re-radiation by the slot antenna.

* * * * *